US007469943B2

(12) United States Patent
Hiramoto

(10) Patent No.: US 7,469,943 B2
(45) Date of Patent: Dec. 30, 2008

(54) OPERATING DEVICE OF A DOOR LATCH IN A VEHICLE

(75) Inventor: Shigenori Hiramoto, Kai (JP)

(73) Assignee: Mitsui Mining and Smeling Co., Ltd. (JP)

( * ) Notice: Subject to any disclaimer, the term of this patent is extended or adjusted under 35 U.S.C. 154(b) by 9 days.

(21) Appl. No.: 11/564,437

(22) Filed: Nov. 29, 2006

(65) Prior Publication Data

US 2007/0138801 A1 Jun. 21, 2007

(30) Foreign Application Priority Data

Nov. 30, 2005 (JP) ..... 2005-346795

(51) Int. Cl.
*E05C 3/06* (2006.01)

(52) U.S. Cl. ..... 292/201

(58) Field of Classification Search ..... 292/216, 292/201, DIG. 23, DIG. 46, 146.1–146.16; 49/279–282, 300
See application file for complete search history.

(56) References Cited

U.S. PATENT DOCUMENTS 3,572,791 A * 3/1971 Foley ..... 292/216
5,106,135 A * 4/1992 Menke et al. ..... 292/216
5,718,465 A * 2/1998 Dowling et al. ..... 292/216
5,893,593 A * 4/1999 Dowling ..... 292/336.3
6,032,987 A * 3/2000 Fukumoto et al. ..... 292/216
6,235,513 B1 * 5/2001 Rothe et al. ..... 435/194
6,364,379 B1 * 4/2002 Roberts et al. ..... 292/216
6,561,557 B2 * 5/2003 Choi ..... 292/336.3
7,222,459 B2 * 5/2007 Taniyama ..... 49/280
2005/0236847 A1 * 10/2005 Taniyama ..... 292/216
2006/0290143 A1 * 12/2006 Watanabe et al. ..... 292/216
2007/0284892 A1 * 12/2007 Nozawa ..... 292/216

FOREIGN PATENT DOCUMENTS

JP 2002-30843 1/2002

* cited by examiner

*Primary Examiner*—Patricia Engle
*Assistant Examiner*—Mark Williams
(74) *Attorney, Agent, or Firm*—Ostrolenk, Faber, Gerb & Soffen, LLP

(57) ABSTRACT

A door operating device is provided in a door of a vehicle and connected to a door latch allowing a striker of the vehicle to engage with or disengage from the door latch. The door operating device comprises an outside lever, a release lever under the outside lever and a locking lever connected to an actuator. In a locking position, only the outside lever rotates, while both the outside and release levers rotates in an unlocking position. The locking lever comprises first and second lever portions which separately move. If malfunction occurs, the second lever portion is moved by an actuator.

6 Claims, 6 Drawing Sheets

OPERATING DEVICE OF A DOOR LATCH IN A VEHICLE

BACKGROUND OF THE INVENTION

The present invention relates to an operating device of a door latch in a vehicle to operate a vehicle door, particularly to an operating device for operating a door latch mechanism of a sliding door.

As disclosed in JP2002-30843A, such an operating device comprises an outside handle on a sliding door, a handle lever released by door opening means such as an inside handle, a release lever connected to a door latch mechanism; a locking lever movable between an unlocking position and a locking position based on power source such as an actuator and a locking knob; and a cooperating member which moves with the locking lever between the unlocking and locking positions to allow releasing of the handle lever to be transmitted to the door latch mechanism in the unlocking position and to make it impossible to be transmitted in the locking position.

However, in the operating device of a door latch for a vehicle in JP2002-30843A, when the locking lever and cooperating member are in the locking position, if the door-opening means is operated together with the power source, the locking lever and cooperating member are still in the locking position to involve malfunction though the power source is actuated for unlocking. This is because the handle lever is released by the door-opening means when the cooperating member is in the locking position to allow the cooperating member to move and engage in a cam hole to stop movement from the locking position to the unlocking position. Thus, if malfunction occurs, the locking lever is still in the locking position even if the door-opening means returns to a position before operation, causing necessity of operation of the power source again to lead troublesome operation.

SUMMARY OF THE INVENTION

In view of the disadvantages of the invention, it is an object of the invention to provide an operating device of a door latch in a vehicle to avoid malfunction when a door-opening means is operated together with a power source, improving operating capability.

BRIEF DESCRIPTION OF THE DRAWINGS

The features and advantages of the invention will become more apparent from the following description with respect to embodiments as shown in accompanying drawings wherein.

DETAILED DESCRIPTION OF PREFERRED EMBODIMENTS

Figure 1:
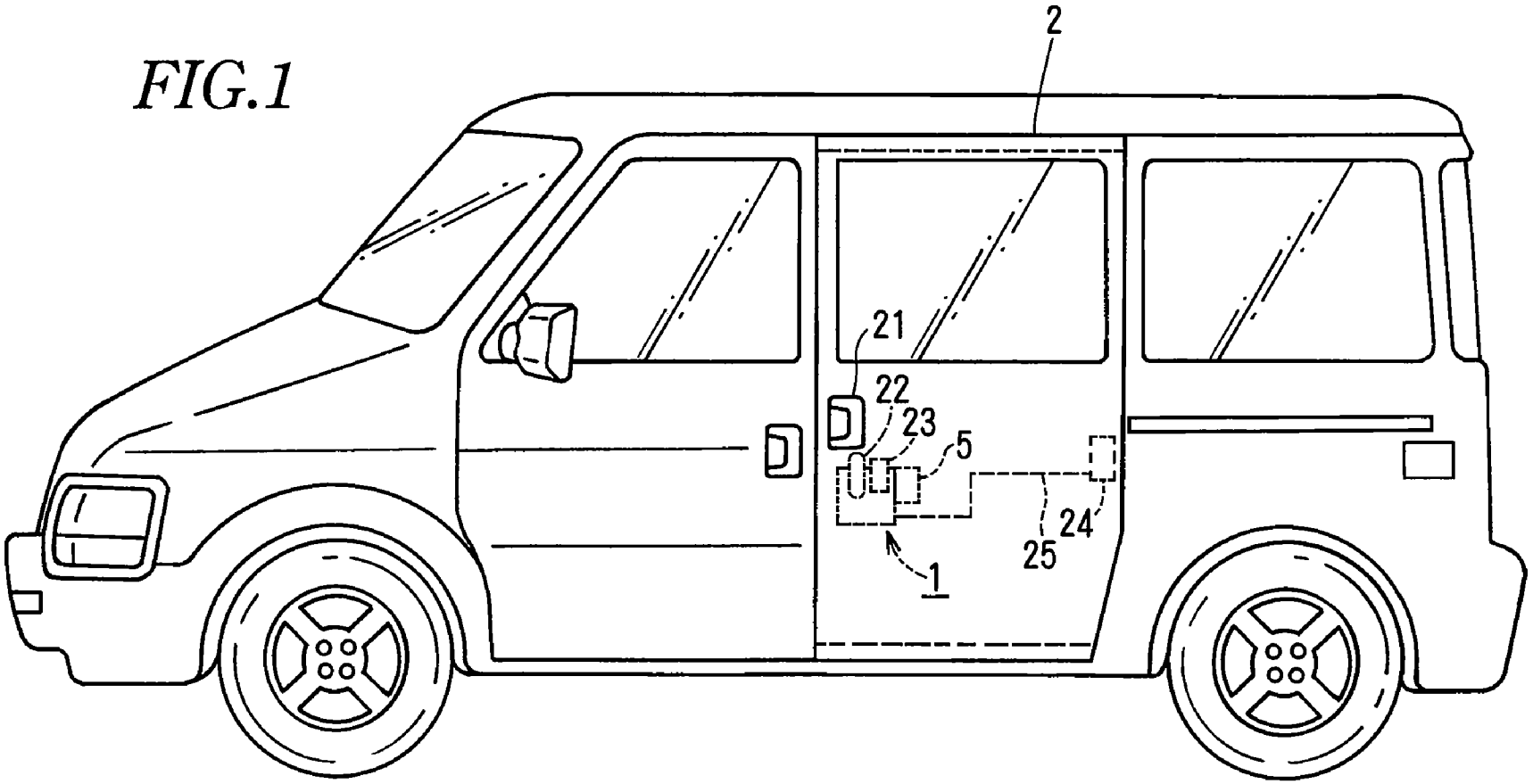
FIG. 1 is a side elevational view of a vehicle having a sliding door to which the present invention is applied.

An operating device 1 comprises an outside lever 3 or a handle lever released by an outside handle 21 as door-opening means outside a sliding door 2 on a base plate 9; an inside lever 4 released by an inside handle 22 inside the sliding door 2 on the base plate 9; a motor-type actuator 5 as power source; a locking lever 6 connected to the actuator 5 and a locking knob 23 inside the sliding door 2; a release lever 7 connected via a cable 25 to a door-latch mechanism 24 at the rear part inside the sliding door 2; an engagement pin 12 moving with the locking lever 6; and a child-proof lever 8.

The door-latch mechanism 24 engages with a striker (not shown) fixed to a vehicle body to keep the sliding door 2 in a full-closed position, and disengages from the striker to enable the sliding door 2 to open.

The outside lever 3 is pivotally secured to the base plate 9 on a pivot 10 and has an inverted-L-shaped cam opening 31 comprising a vertical hole portion 31*a* and a horizontal hole portion 31*b* extending horizontally from the upper end of the vertical hole portion 31*a*.

Figure 2:
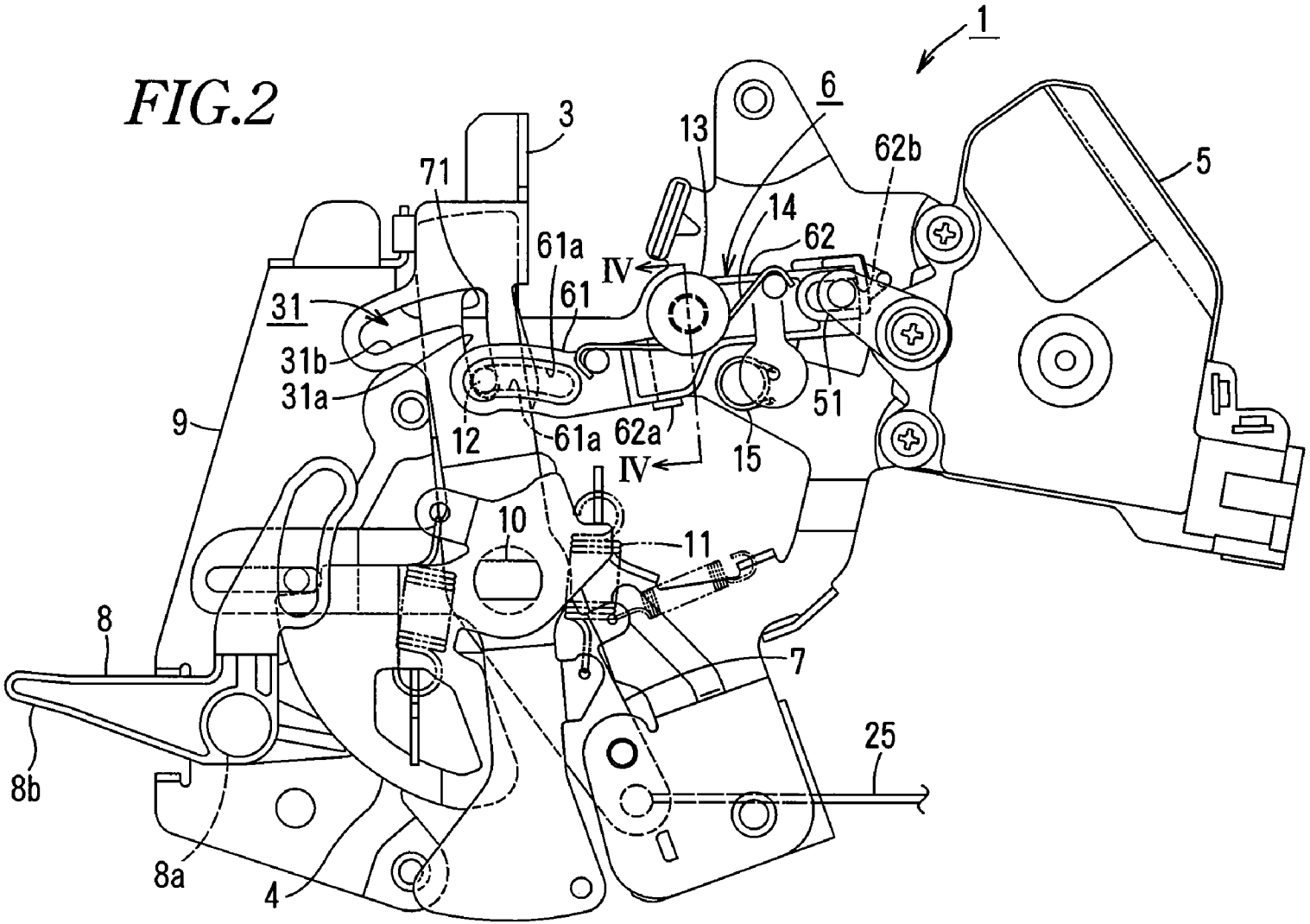
FIG. 2 is a side elevational view of an operating device according to the present invention.
Figure 5:
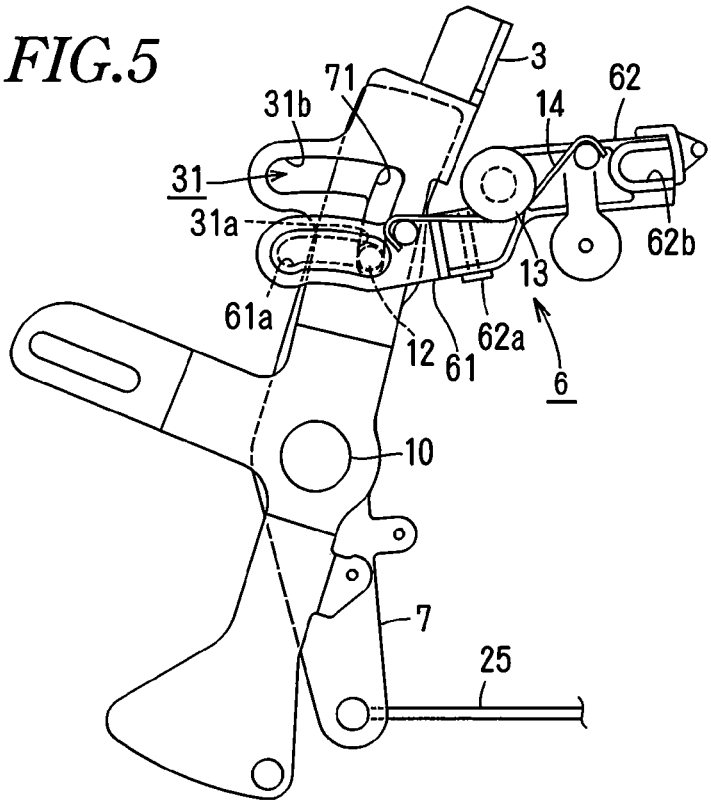
FIG. 5 is a side elevational view of the main part where a handle lever is moved in a locking position.
Figure 6:
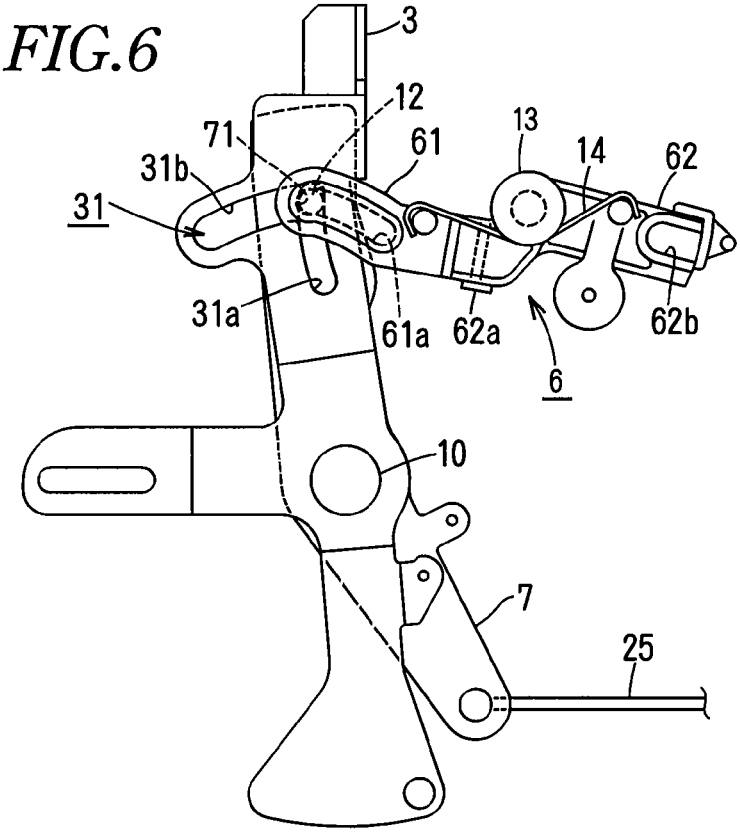
FIG. 6 is a side elevational view of the main part in the locking position.
Figure 7:
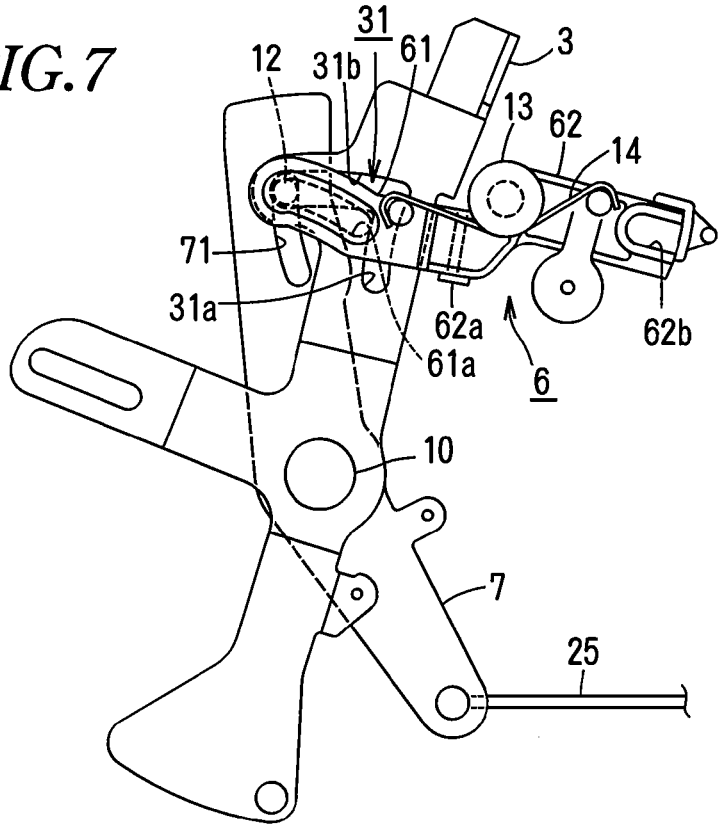
FIG. 7 is a side elevational view of the main part in which the handle lever is moved in the locking position.
Figure 8:
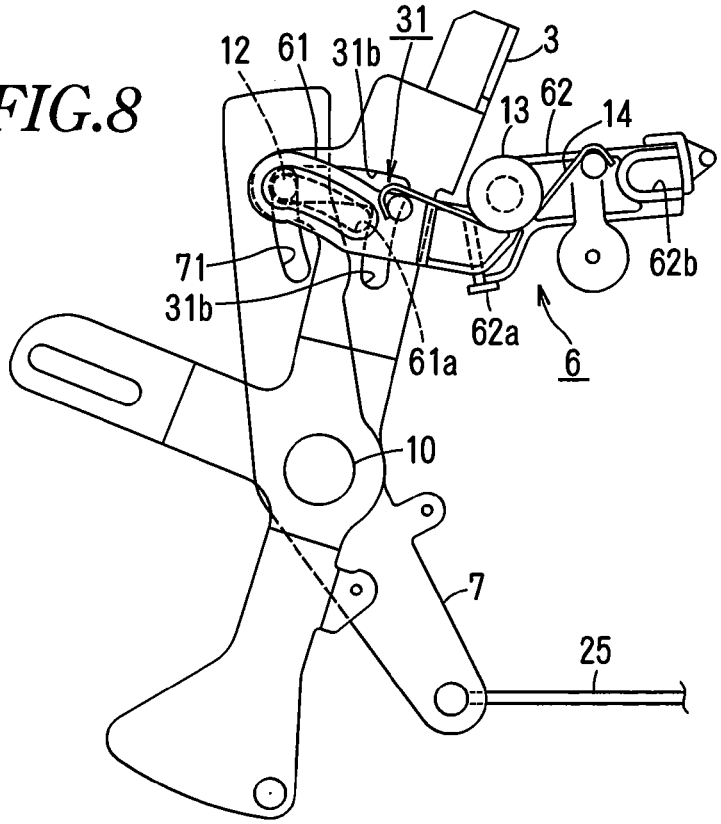
FIG. 8 is a side elevational view of the main part in which the handle lever is moved for releasing and a power source is actuated for unlocking.
Figure 9:
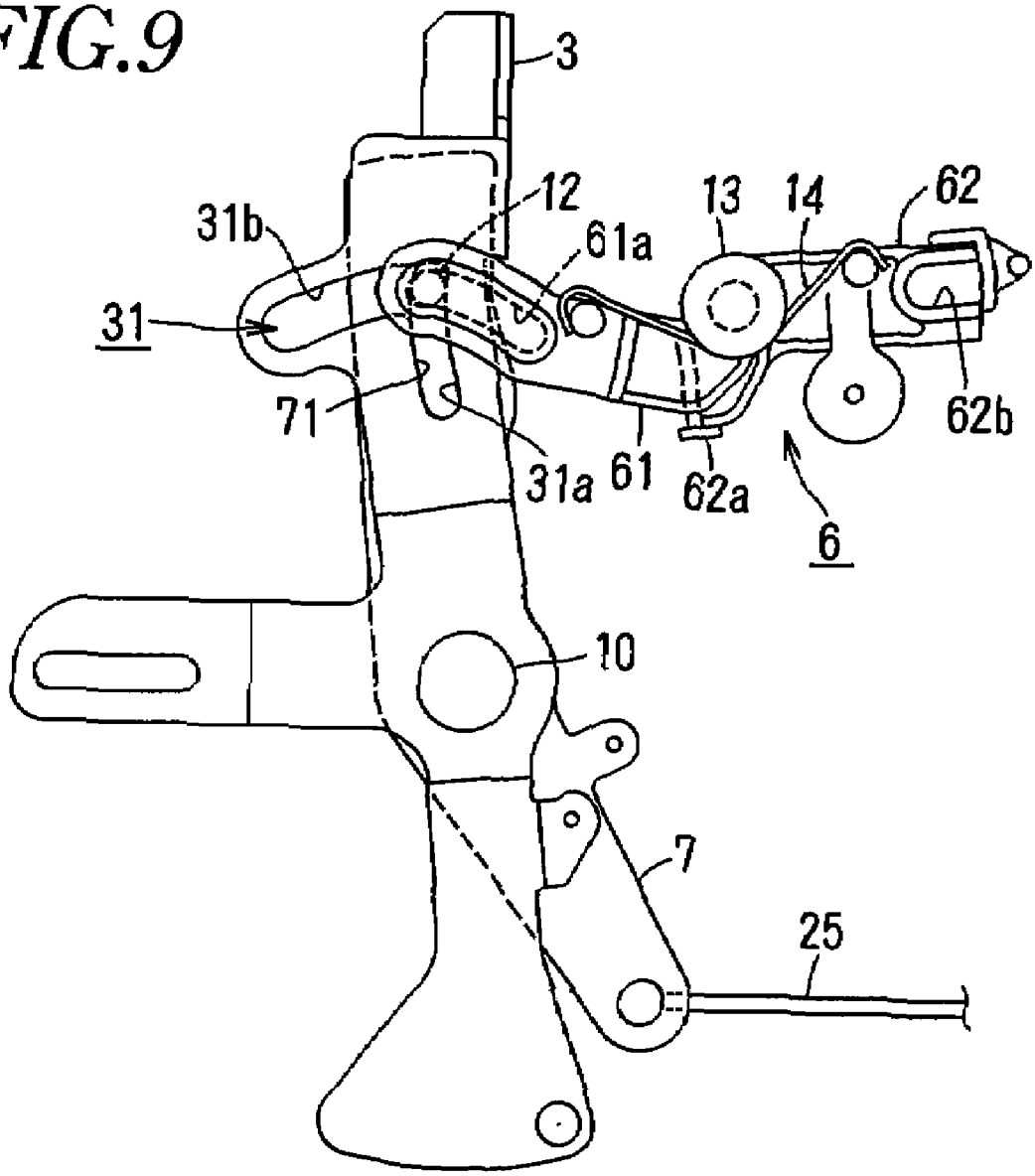
FIG. 9 is a side elevational view of the main part in which the second locking lever is movable to an unlocking position.

When the outside handle 21 is operated to open the sliding door, the outside lever 3 is moved from a waiting position in FIGS. 2, 6 and 9 to a releasing position in FIGS. 5, 7 and 8 in a clockwise direction.

The inside lever 4 is pivoted to the base plate 9 to rotate together with the pivot 10 and released with the pivot 10 on the basis of opening operation of the inside handle 22 fixed in the side end in a clockwise direction in FIG. 2.

The child-proof lever 8 is pivotally secured to the base plate 9 on a pivot 8*a* and has an operating part 8*b* projecting from the front end of the sliding door 2. The operating part 8*b* is operated up and down while the sliding door 2 is opened and changes to an unlocking position in FIG. 2 to enable release of the inside lever 4 to be transmitted to the outside lever 3 and to a locking position to make it impossible to be transmitted by rotating in an anticlockwise direction from the unlocking position.

The release lever 7 is pivotally secured to the base plate 9 on the pivot 10 independently from the outside lever 3 and inside lever 4 and has a vertical elongate hole 71 along a cam hole 31 of the outside lever 3. The release lever 7 is moved from the waiting position in FIG. 2 to the release position in FIG. 5, so that the latch mechanism 24 is released by the cable 25 enabling the sliding door 2 to open.

An engagement pin 12 extends transversely of the vehicle and slidably engages in the cam hole 31 of the outside lever 3 and the elongate hole 71 of the release lever 7. By the locking lever 6, the pin 12 moves between an unlocking position in FIGS. 2 and 5 where the pin 12 is positioned at the lower end of the engagement hole 31*a* of the cam hole 31 and a locking position where the pin 12 is positioned at the upper end. In the unlocking position, releasing of the outside lever 3 can be transmitted to the release lever 7, and in the locking position, releasing of the outside lever 3 cannot be transmitted to the release lever 7.

The actuator 5 is positioned behind the outside lever 3 and release lever 7. In the front of the actuator 5, an output lever 51 is pivotally secured between the unlocking position in FIG. 2 and locking position to which FIG. 2 rotates in an anticlockwise direction.

The locking lever 6 is positioned between the outside lever 3 and the output lever 51 of the actuator 5, and comprises a first lever portion 61 engaged with the engagement pin 12 and a second lever portion 62 coupled to the output lever 51 of the actuator 5.

Between the first and second lever portions 61 and 62, the locking lever 6 is pivotally secured to the base plate 9 on a pivot 13. On the pivot 13, a spring 14 is wound. One end of the spring 14 is coupled to the pivot 13 and the other end of the spring 14 is coupled to the second lever portion 62. Thus, the first lever portion 61 is forced against the second lever portion 62 by the spring 14 in an unlocking direction or anticlockwise direction in FIG. 2 and FIGS. 5-9. Usually, the first lever portion 61 is kept to allow the lower edge to contact the upper surface of an engagement portion 62*a* in FIG. 2 and FIGS. 5-7 and changed with the second lever portion 62 to the unlocking position in FIGS. 2 and 5 and locking position in FIGS. 8 and 9.

In the front of the first lever portion 61, a guide groove 61*a* is formed to extend perpendicular to the cam hole 31 of the outside lever 3 and the elongate hole 71 of the release lever 7. The engagement pin 12 engages in the guide groove 61*a* slidably.

The first lever portion 61 is moved with the second lever portion 62 from the unlocking position in FIG. 2 to the locking position in FIG. 6 to allow the engagement pin 12 to move from the unlocking position to the locking position and vice versa.

Figure 3:
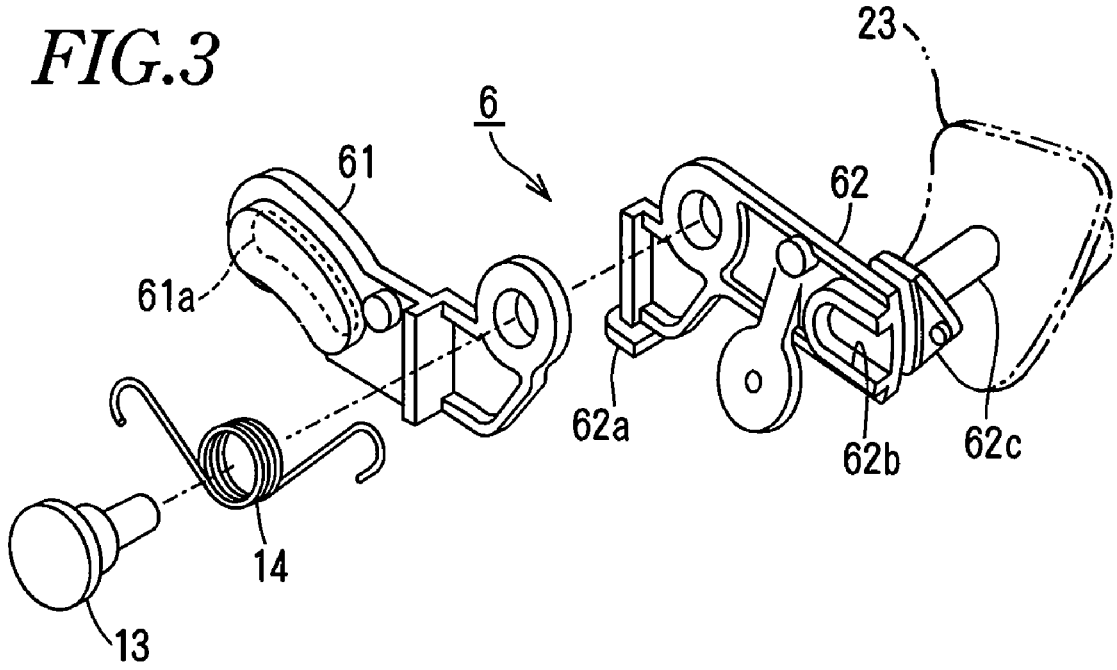
FIG. 3 is an exploded perspective view of the main part of the invention.
Figure 4:
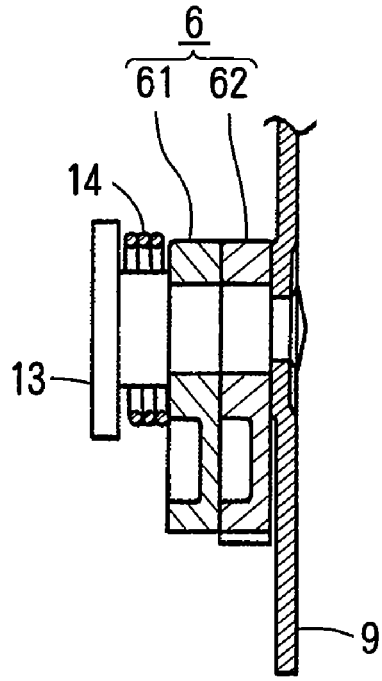
FIG. 4 is a vertical sectional view taken along the line IV-IV in FIG. 2.

In the second lever portion 62, the output lever 51 of the actuator 5 and locking knob 23 are connected to a connecting groove 62*b* at the rear end and a connecting rod 62*c* (in FIG. 3) projecting towards the inside of the vehicle respectively to allow it to move between the unlocking position in FIGS. 2, 5, 8 and 9 and locking position in FIGS. 6 and 7 based on the operation of the output lever 51 and the locking knob 23.

Between the second lever portion 62 and the base plate 9, a turnover spring 15 is provided to keep the second lever portion 62 in the unlocking and locking positions with biasing force, which is determined to be greater than force of the spring 14 acting between the first and second levers 61 and 62. Thus, in FIG. 9, keeping the second lever portion 62 in the unlocking position, the first lever portion 61 can be surely moved from the locking position to the unlocking position by force of the spring 14.

Operation of the embodiment of the invention will be described below.

As shown in FIG. 2, when the operating device 1 is in the unlocking position in which the first and second lever portions 61,62 of the locking lever 5 and the engagement pin 12 are in the unlocking position, the outside lever 3 is moved by opening operation of the outside handle 21 or inside handle 22 to allow the engagement pin 12 to engage on the front edge of the vertical hole portion 31*a* of the cam hole 31 and moves with the outside lever 3. Thus, as shown in FIG. 5, the release lever 7 is moved with the outside lever 3 via the engagement pin 12 to release latching of the door-latch mechanism 24 to enable the sliding door 2 to open.

As shown in FIG. 6, when the operating device 1 is in the locking position in which the first and second lever portions 61,62 of the locking lever 6 and the engagement pin 12 are locked, even if the outside lever 3 is moved with opening operation of the outside handle 21 or inside handle 22, the engagement pin 12 slides forwards in the horizontal hole portion 31*b* of the cam hole 31 to allow release of the outside lever 3 not to be transmitted to the release lever 7, thereby making it impossible to release latching of the door-latch mechanism 24.

In FIG. 7, when the output lever 51 of the actuator 5 is moved for unlocking by an inside switch (not shown) or remote control switch (not shown), the engagement pin 12 engage on the lower edge of the horizontal hole portion 31*b* to make it impossible to move in an unlocking direction. Thus, while the engagement pin 12 and the first lever portion 61 is kept in the locking position, only the second lever portion 62 moves from the locking position to the unlocking position against force of the spring 14 and kept in the unlocking position by the turnover spring 15.

Thereafter, the outside handle 21 or inside handle 22 returns to a position before opening operation to return the outside lever 3 to the waiting position, and the engagement pin 12 moves to the upper end of the engagement hole portion 31*a* of the cam hole 31 as shown in FIG. 9 thereby enabling the engagement pin 12 to move to the unlocking position, so that the first lever portion 61 and engagement pin 12 is moved to the unlocking position by force of the spring 14 as shown in FIG. 2. And the outside handle 21 or inside handle 22 is opened, enabling the door-latch mechanism 24 to be released.

Accordingly, even if the outside handle 21 or inside handle 22 and actuator 5 are operated together, the outside handle 21 or inside handle 22 is returned to a position before operation enabling the locking lever 6 and engagement pin 12 to move to the unlocking position to improve operation capability.

The foregoing merely relate to an embodiment of the invention. Various changes and modifications may be made by a person skilled in the art without departing from the scope of claims wherein:

What is claimed is:

1. An operating device of a door latch in a vehicle, comprising:

a base plate;

a first pivot on the base plate;

a handle lever mounted to the base plate via a first spring, said handle lever being pivoted on the first pivot against force of the first spring by door-opening means;

a release lever mounted to the base plate via a second spring under the handle lever, said release lever being pivoted on the first pivot against force of the second spring with the handle lever in an unlocking position in which the door latch connected to a lower end of the release ever disengages from a striker fixed to the vehicle while the handle lever is only pivoted in a locking position in which the door latch engages with the striker;

an engagement pin mounted to the release lever;

a second pivot spaced from the first pivot longitudinally of the vehicle on the base plate;

an actuator spaced from the second pivot longitudinally of the vehicle on the base plate;

a locking lever comprising a first lever portion and a second lever portion, the first lever portion engaging with the engagement pin at a first end and being connected to the second pivot at a second end, the second lever portion being connected to the second pivot at a first end and to the actuator at a second end;

an output lever connecting the locking lever to the actuator;

a third spring being wound on the second pivot, wherein the handle lever has a cam hole comprising a vertical hole portion and a horizontal hole portion extending at an upper end of the vertical hole portion, said release lever having an elongate hole over which the vertical hole portion of the cam hole extends, the first lever portion of the locking lever having a horizontal guide groove in which the engagement pin slidably engages, the handle lever only rotating while the release lever does not move when the engagement pin is in the upper end of the vertical hole portion in the locking position, the handle lever and the release lever being moved together when the engagement pin is in a lower end of the vertical hole portion to move slidably in the guide groove of the first lever portion of the locking lever in the unlocking position.

2. An operating device of claim 1 wherein the second lever portion is moved by the actuator to allow the engagement pin to move the lower end of the vertical hole portion as the unlocking portion if the engagement pin engages in the horizontal hole portion of the cam hole of the handle lever.

3. An operating device of claim 1 further comprising a turnover spring for keeping the second lever portion in the locking and unlocking positions, force of the turnover spring being greater than force of the third spring.

4. An operating device of a door latch in a vehicle, comprising:

a base plate;

a first pivot on the base plate;

a handle lever mounted to the base plate via a first spring, said handle lever being pivoted on the first pivot against force of the first spring by door-opening means;

a release lever mounted to the base plate via a second spring under the handle lever, said release lever being pivoted on the first pivot against force of the second spring with the handle lever in an unlocking position in which the door latch connected to a lower end of the release ever disengages from a striker fixed to the vehicle while the handle lever is only pivoted in a locking position in which the door latch engages with the striker;

an engagement pin mounted to the release lever;

a second pivot on the base plate;

an actuator;

a locking lever comprising a first lever portion and a second lever portion, the first lever portion engaging with the engagement pin at a first end and being connected to the second pivot at a second end, the second lever portion being connected to the second pivot at a first end and to the actuator at a second end; and a third spring being wound on the second pivot, wherein the handle lever has a cam hole comprising a vertical hole portion and a horizontal hole portion extending at an upper end of the vertical hole portion, said release lever having an elongate hole over which the vertical hole portion of the cam hole extends, the first lever portion of the locking lever having a horizontal guide groove in which the engagement pin slidably engages, the handle lever only rotating while the release lever does not move when the engagement pin is in the upper end of the vertical hole portion in the locking position, the handle lever and the release lever being moved together when the engagement pin is in a lower end of the vertical hole portion to move slidably in the guide groove of the first lever portion of the locking lever in the unlocking position.

5. An operating device of claim 4 wherein the second lever portion is moved by the actuator to allow the engagement pin to move the lower end of the vertical hole portion as the unlocking portion if the engagement pin engages in the horizontal hole portion of the cam hole of the handle lever.

6. An operating device of claim 4 further comprising a turnover spring for keeping the second lever portion in the locking and unlocking positions, force of the turnover spring being greater than force of the third spring.

* * * * *